US005915321A

United States Patent [19]

Fountaine

[11] Patent Number: 5,915,321

[45] Date of Patent: Jun. 29, 1999

[54] MULTIHULL NAVIGATING STRUCTURE

[76] Inventor: Jean-François Fountaine, 2 rue de l'Eglise, F-17290 Thaire d'Aunis, France

[21] Appl. No.: 08/809,585

[22] PCT Filed: Sep. 18, 1995

[86] PCT No.: PCT/FR95/01195

§ 371 Date: Apr. 25, 1997

§ 102(e) Date: Apr. 25, 1997

[87] PCT Pub. No.: WO96/09204

PCT Pub. Date: Mar. 28, 1996

[30] Foreign Application Priority Data

Sep. 22, 1994 [FR] France ..... 94 11543

[51] Int. Cl.[6] ..... B63B 1/00

[52] U.S. Cl. ..... 114/61; 114/77 R

[58] Field of Search ..... 114/77 R, 71, 114/61, 258–260, 26–31

[56] References Cited

U.S. PATENT DOCUMENTS

| | | | |
|---|---|---|---|
| 2,405,115 | 8/1946 | Creed | 114/61 |
| 4,476,798 | 10/1984 | Backus | 114/77 R |
| 4,557,211 | 12/1985 | Schmidt | 116/61 |
| 4,732,103 | 3/1988 | Culbertson | 114/71 |

*Primary Examiner*—Ed L. Swinehart
*Attorney, Agent, or Firm*—Young & Thompson

[57] ABSTRACT

A multihull navigating structure, such as a catamaran, includes a floating base (10) comprising two hulls (12), means (14) to render integral the hulls, a motor (16) disposed in at least one of the hulls, fluid and electric power supply networks, a control station (20), a support platform (22) integral with the floating base (10) and adapted to operate in two operating modes. In the first mode passenger modules (24) are carried on the platform and in the second mode freight modules are carried on the platform.

13 Claims, 4 Drawing Sheets

MULTIHULL NAVIGATING STRUCTURE

BACKGROUND OF THE INVENTION

The present invention concerns a multihull navigating structure with a variable operating mode.

In the maritime field, there are many navigating type structures each dedicated to one mode of operation, also depending on the distances to be covered.

The sphere of application of the present application more particularly concerns short and medium distances.

This is why there are boats for carrying passengers, more particularly ferry boats, river barges for transporting bulk materials, coasters with a plate for transporting containers or bulky elements occupying a large amount of space, and more rarely mixed units.

These boats have specific capacities which cannot be modulated according to needs.

Users are currently confronted with this disparity of needs during the course of time.

In fact, if one takes a ferry boat to carry out rapid rotations of passengers between a continent and an island for example, one can readily understand that the passenger traffic rate is more higher during the tourist season and that the requirements for raw materials, namely freight, are much greater during the rest of the year.

Similarly, as regards shorter cycles, one usage per day or at weekends can be anticipated and a different usage in the night or during the week.

When this type of boat is hired out from a company, the user can clearly specify his requirements and, according to the periods, rent various types of boats but the contracts shall be different with obviously higher prices.

The user, for example a local collectivity, can also provide the investment, but to ensure that this is profitable, he must either buy two types of boat or make the boat operate with an inadequate compromise between requirements and the possibilities of the boat.

No solution seems to be satisfactory, especially as the periods and requirements are generally approximately the same for the users of a given region.

It is also necessary to take into account maritime laws which are extremely constricting having regard to the environment on which the fleets are sailing.

These laws are much more restrictive when passengers are concerned.

Apart from the needs for the sufficient mechanical resistance of the structure in given circumstances, which is a basic obligation to obtain certification, it is proper to in particular provide all the required emergency exits to evacuate passengers, a partitioning of the engine room so as to separate the passenger compartments for obvious reasons of safety should a fire occur, as well as providing access for the boat personnel to the various rooms without there being an obligation to pass into one to reach another.

Similarly, even if certain constraints are not legally imposed, it is nevertheless essential to accept these so as to improve passenger comfort.

This is in particular the case with sanitary and ventilation installations.

There are also requirements common to all these boats: moving speed, low consumption, hence overall aerodynamics and seaworthiness.

There are boats for carrying passengers which generally include two hulls surmounted by a cell disposed for receiving passengers so as to form a motorised catamaran.

The cell forms an integral part of the structure and fully contributes in providing mechanical resistance of the unit.

Motorization is of the turbine and hydro-jet type so as to avoid increasing draft and drag and also is provided for safety reasons.

These boats move at high speeds but only have an extremely reduced freight capacity.

SUMMARY OF THE INVENTION

The aim of the present invention concerns a multihull navigating structure able to extremely quickly modulate the effective space according to requirements, one which may also be mixed, is aerodynamic, which offers all the necessary safety guarantees, which is stable whose service and motor compartment(s) remain accessible to the boat personnel independently of the passenger compartments or more generally of the load and which make it possible to use in particular hydro-jet type motorisations.

According to the usual navigation conditions of the navigating structure, the hydro-jet type motorisation could be replaced by a shaft and propeller type motorisation as on most boats, but advantageously in certain conditions by a surface or cavitating propeller.

It ought to be mentioned that the fact of including motorisation and fuel reserves in the hulls improves the safety of passengers should a fire occur since they are totally isolated from the hulls sheltered in the modular elements, as described subsequently. Comfort is also increased by suppressing most of the noise and vibrations propagated from the hulls.

To this effect, according to the invention, the navigating multihull structure, especially a catamaran, includes a floating base comprising hulls, means to render integral these hulls, a motorisation disposed in at least one of the hulls, fluid and electric power supply networks and a control station, said structures being characterised in that it includes a support platform integral with the floating base and provided to movably receive at least one modular element adapted to the type of transport to be embodied.

According to another characteristic of the invention, the modular elements are cells for the transport of passengers and equipped at least with seats.

Moreover, the cells include means for automatically connecting with the fluid and electric energy power supply networks of the platform.

Means for communication are also provided between the cells allowing access of one of the cells to the adjacent cell and to the outside world.

According to one embodiment variant, for the purpose of a different use, the modular elements are free load containers.

In the main embodiment, the hulls are connected by at least three arms forming a platform support.

According to another characteristic of the invention, the width of the hulls is reduced with respect to their length so as to provide them with excellent aerodynamic efficiency.

So as to obtain the sought-after shapes, the entire structure is made of a composite material and/or light alloy.

According to one particular disposition, the effective portion of the platform includes at least one portion of its free surface to receive freight or to be equipped with movable seats.

Furthermore, so as to improve aerodynamics, the compactness and for facilitating the means for access to the platform and the modular elements, stairs are integrated in the hull linking means.

BRIEF DESCRIPTION OF THE DRAWINGS

The present invention is described hereafter with reference to the accompanying drawings representing a particular non-restrictive embodiment of the navigating structure of the invention, said drawings containing.

DESCRIPTION OF THE PREFERRED EMBODIMENTS

Figure 1:
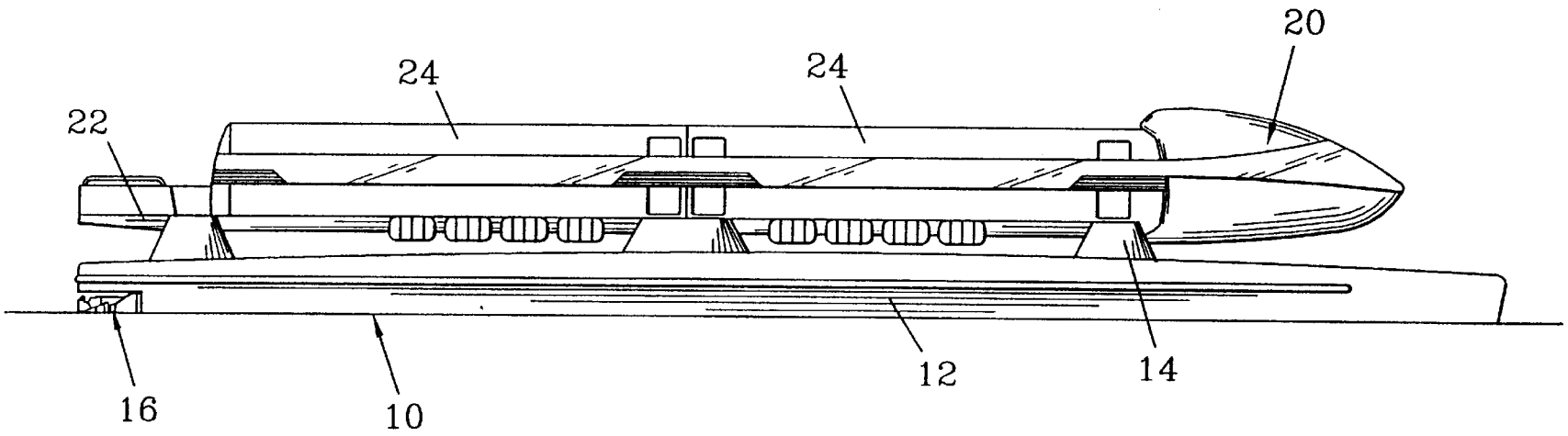
FIG. 1 showing a side view of the navigating structure of the invention.

FIG. 1 shows a navigating structure with 8 modules.

Figure 2:
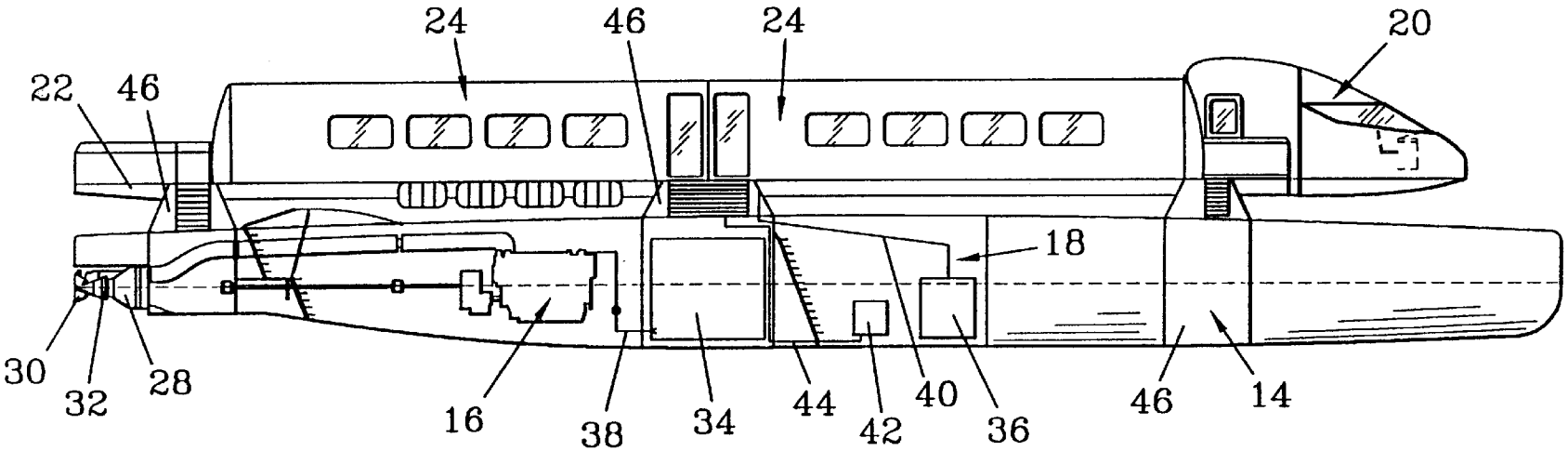
FIG. 2 showing a side view with a partial section of the hulls.
Figure 3:
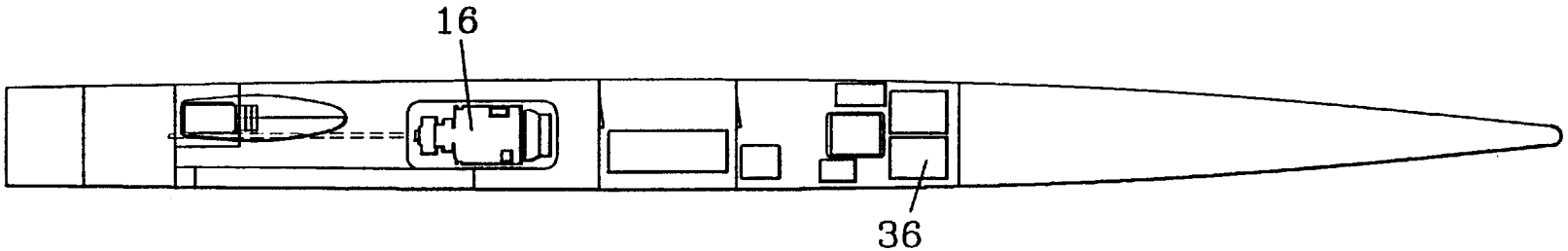
FIG. 3 showing a top view of one of the hulls.

This structure includes a floating base 10 comprising two hulls 12, means 14 to render integral these two hulls, a motorisation 16, electric supply and fluid networks 18 visible in more detail on FIG. 2, and a control station 20.

This structure further includes a support platform 22 integral with the floating base, as well as modular elements 24 fixed movably to said platform.

The mechanical resistance of the floating base including the platform is calculated so as to be self-supporting but also support a given additional load.

FIG. 2 shows the motorisation and more particularly one of the two motors 26 housed in one of the hulls 12 and which feeds a water turbine 28.

An additional rudder 30 provides the directional deviations and a back thrust member 32 is able to invert the direction of thrust so as to render possible rear navigation, as is known.

In the hull, the fuel 34 and water 36 tanks are respectively connected to the motors and modular elements by pipes diagrammatically shown at 38 and 40.

The generator set 42 feeds the entire structure with electric energy by means of a simplified main link shown at 44.

The means to render integral the two hulls include arms 46 distributed at three points for safety reasons, said arms therefore being three arms, namely front, middle and rear. Two of these arms are sufficient to ensure the mechanical behaviour of the unit but the standards require ensuring resistance of the structure should one the arms break with the result that the best solution consists of adding the third arm, as in the embodiment shown.

The support platform 22 is initially empty so as to be able to have various types of loads.

In the embodiment represented, the platform is applied to the carrying of passengers and with this aim in mind the modular elements 24 each include two rows 48 of seats 50, toilets 52 and storage boxes 54.

The modular elements are able to intercommunicate via doors 56 but also with the outside world at the right of the arms 46, which constitutes isolation means or on the contrary safety means to facilitate the evacuation of the passengers.

The boat personnel can also move outside the modules or inside them.

Stairs 58 are preferably fitted directly in the arms 46.

The control cabin 20 includes known types of stations on board a boat, such as the actual control console 60 and the maps table 62.

A highly panoramic station ensures that the pilot has excellent visibility.

The control cabin forms an intrinsic part of the floating structure and has no movability character.

A relaxation space 64 is provided permanently between the control station 20 and the platform 22.

Provided on the rear area and the edges of the floats are all the emergency equipment items, such as survival containers 66 and a pneumatic safety or emergency boat 68.

The elements are equipped with automatic locking mechanical connection means, like the free load containers, with standard dimensions.

It is useful to provide fast automatic connectors for the fluids and electric links. These connectors are well known and shall be adapted to this particular application.

The ventilation of these elements or preferably air conditioning is integrated, autonomous and independent.

It shall also be noted that the environment inside the hulls and the modular elements are separated, which strengthens safety, especially should a fire occur.

In addition, the modular elements act as a barrier to the propagation of vibrations and noise emitted by the motorisation inside the hulls.

Waterproofness shall be provided at the right of the doors by bellows or any other simple device as the space between two elements is extremely small, which limits the required mechanical resistance.

Figure 5:
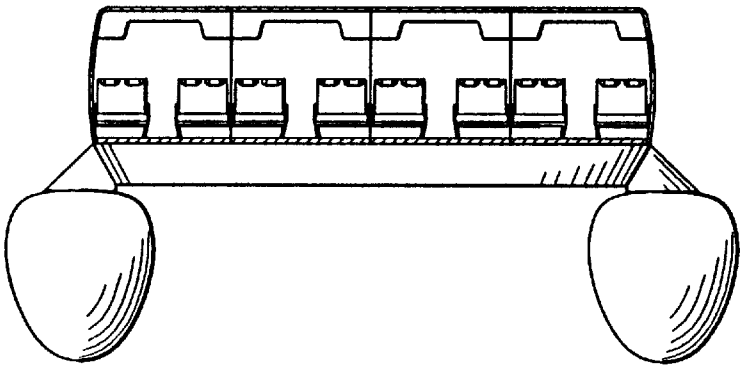
FIG. 5 showing a transverse sectional view revealing the internal disposition, and FIG. 6 showing a top view with a partial section illustrating the internal disposition.
Figure 4:
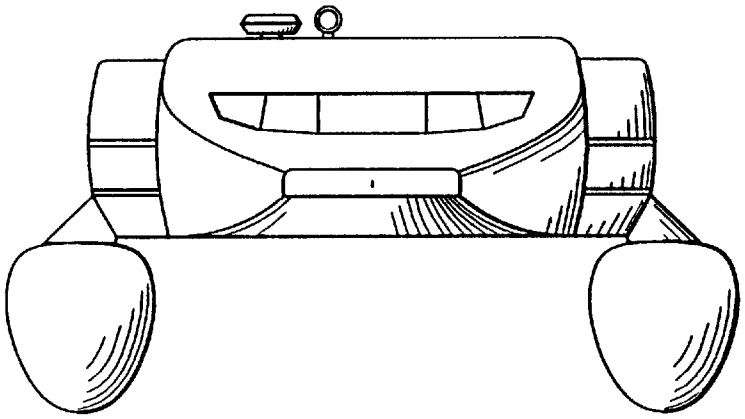
FIG. 4 showing a front view of the structure of FIG. 1.
Figure 6:
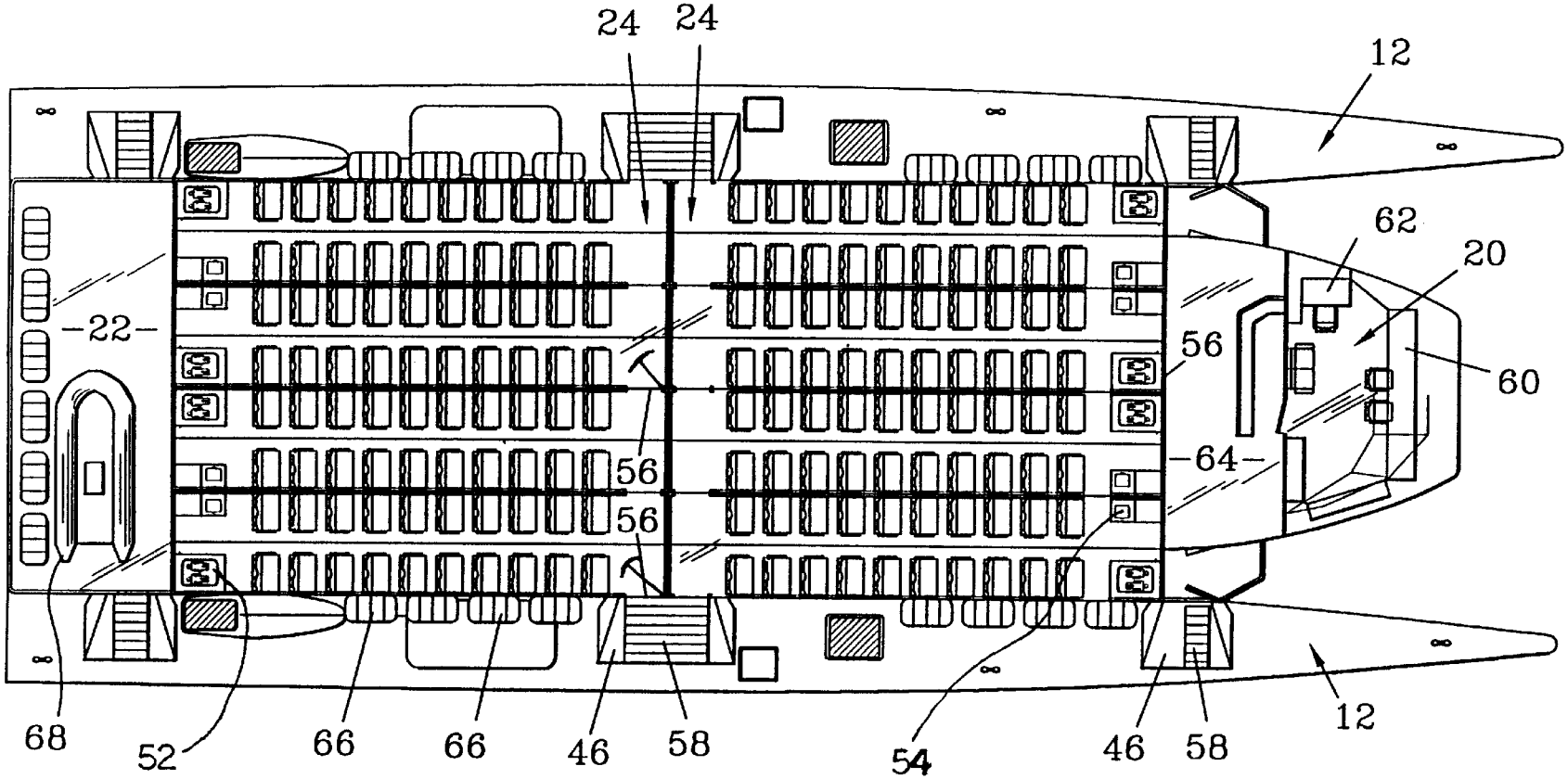

FIGS. 4 and 5 show more clearly the aerodynamics of the structure rendered possible via an integration of the various elements and significant compactness.

In the embodiment represented, the aerodynamic efficiency of the hulls limits drag and increases performances whilst preserving considerable stability for the passengers when the elements are modules for this type of transport, but stability is also highly valued for the transport of free load containers.

This structure may also be equipped with all sorts of accessories and the containers can be replaced by cisterns or open tanks for transporting bulk materials.

It is to be noted that the adaptability of this transport device is quite considerable, the profitability of said device having been improved by a very important usage rate.

In fact, the changes of modular elements is effected easily since the connections are automatic.

It is therefore possible to consider a day usage for a passenger application and a cargo usage in the night for the transport of loads, such as construction materials.

Another mixed use likely to be of interest to operators is of dividing the support platform into two spaces, one being equipped with modular elements for passenger transport, and the other being free so as to receive freight but also as a replacement passenger seats movably secured to this space.

In this instance, a sun cover can be installed on a suitable structure.

Similarly, the safety equipment currently required by the law is provided and at all events the presence of a peripheral railing is essential.

This navigating structure shall be preferably embodied made of a composite material and/or light alloy according to the required mechanical resistances, the shapes to be embodied, the weight to be reached and not prohibiting the local use of certain other specific materials.

This type of navigating structure is particularly advantageous for the transfer over short and average-sized distances.

Similarly, certain passenger elements may be at two decks, which doubles passenger capacity for a slightly greater height spatial requirement in the same way as on large-capacity transport aircraft or on train coaches. It is also to be noted that the position of the centre of gravity is extremely slightly modified which does not adversely affect comfort and behaviour at sea.

I claim:

1. A catamaran comprising:

two hulls, each of said two hulls having plural spaced-apart arms extending therefrom;

a propulsion system comprising propelling means depending from one of said hulls for propelling the catamaran through water and a motor within said one hull that is connected to said propelling means for powering said propelling means;

a platform connecting said arms of said two hulls so as to provide an integral structure of said two hulls and said platform connected by said plural arms, said platform being arranged and constructed for two modes of operation, namely, a first mode of operation in which at least one passenger-carrying modular element is carried atop said platform and a second mode of operation in which at least one freight-carrying modular element is carried atop said platform; and a control station atop said platform for operating the catamaran.

2. The catamaran of claim 1, further comprising plural passenger-carrying modular elements that each comprises seats for passengers.

3. The catamaran of claim 2, wherein said passenger-carrying modular elements comprise doors for access therebetween.

4. The catamaran of claim 1, wherein each of said hulls comprises three of said arms.

5. The catamaran of claim 1, wherein each of said hulls has a width that is small relative to a length so as to reduce resistance to movement through water.

6. The catamaran of claim 1, wherein at least one of said arms comprises means for access to said platform from a respective one of said hulls.

7. The catamaran of claim 6, further comprising the passenger-carrying modular element, wherein said passenger-carrying modular element comprises a door corresponding to said means for access.

8. The catamaran of claim 1, wherein said platform and said hulls comprise at least one of a composite material and a lightweight alloy.

9. The catamaran of claim 1, wherein said hulls extend farther abeam than said platform and said arms extend at an angle inwardly to said platform.

10. A catamaran comprising:

two hulls, each of said two hulls having plural spaced-apart arms extending upwardly therefrom;

two propulsion systems, one of said propulsion systems in each of said hulls, each of said propulsion systems comprising propelling means depending from a different one of said hulls for propelling the catamaran through water, a motor within said one hull that is connected to said propelling means for powering said propelling means, fuel storage within said one hull that is connected to said motor, and rudder means depending from said one hull for directing movement of the catamaran;

plural passenger-carrying modular elements, each with seats and access means for passengers;

plural freight-carrying modular elements for carrying freight;

electric power supply and fluid networks;

a platform connecting said arms of said two hulls so as to provide an integral structure of said two hulls and said platform connected by said plural arms, said platform being arranged and constructed for two modes of operation, namely, a first mode of operation in which said plural passenger-carrying modular elements are carried atop said platform and connected to said electric power supply and fluid networks and a second mode of operation in which said freight-carrying modular elements are carried atop said platform, said hulls extending farther abeam than said platform and said arms extending at an angle inwardly to said platform; and a control station atop said platform for operating the catamaran.

11. The catamaran of claim 10, wherein at least one of said arms comprises stairs from a respective one of said hulls to one of said access means.

12. The catamaran of claim 10, wherein at least one of said arms comprises stairs from said platform into a respective one of said hulls.

13. The catamaran of claim 10, wherein said platform has a bottom spaced from and exposed to water when the catamaran is afloat and a top on which both types of said elements rest, a space between said top and said bottom having height less than a height of one of said elements.

* * * * *